US007690168B2

(12) United States Patent
LaLonde

(10) Patent No.: US 7,690,168 B2
(45) Date of Patent: Apr. 6, 2010

(54) WALL MOLD ATTACHMENT CLIP

(75) Inventor: Paul D LaLonde, Highland Park, IL (US)

(73) Assignee: USG Interiors, Inc., Chicago, IL (US)

( * ) Notice: Subject to any disclaimer, the term of this patent is extended or adjusted under 35 U.S.C. 154(b) by 1258 days.

(21) Appl. No.: 11/193,718

(22) Filed: Jul. 29, 2005

(65) Prior Publication Data

US 2007/0022690 A1 Feb. 1, 2007

(51) Int. Cl.
*E04B 1/38* (2006.01)

(52) U.S. Cl. ..... 52/506.08; 52/220.6; 52/506.07; 52/665

(58) Field of Classification Search ..... 52/506.06, 52/506.07, 506.08, 506.09, 506.1, 220.6, 52/506.01, 664, 665, 698, 712
See application file for complete search history.

(56) References Cited

U.S. PATENT DOCUMENTS

| | | | | |
|---|---|---|---|---|
| 3,780,973 A | | 12/1973 | Dalton | |
| 4,610,562 A | | 9/1986 | Dunn | |
| 4,715,161 A | | 12/1987 | Carraro et al. | |
| 5,046,294 A | | 9/1991 | Platt | |
| 5,195,289 A | * | 3/1993 | LaLonde et al. | 52/506.06 |
| 5,201,787 A | | 4/1993 | LaLonde et al. | |
| 5,937,605 A | * | 8/1999 | Wendt | 52/506.06 |
| 6,138,425 A | * | 10/2000 | Wendt | 52/506.07 |
| 6,516,582 B2 | | 2/2003 | Paul et al. | |
| 2005/0016112 A1 | | 1/2005 | Franz | |
| 2005/0160696 A1 | | 7/2005 | Kelly et al. | |

* cited by examiner

*Primary Examiner*—Richard E Chilcot, Jr.
*Assistant Examiner*—William V Gilbert
(74) *Attorney, Agent, or Firm*—Pearne & Gordon LLP

(57) ABSTRACT

A clip for attaching the end of a grid tee to a wall angle. The clip, in various forms, is arranged to frictionally lock between the hem of the horizontal leg of the wall angle and the vertical leg. The clip, typically, has a pair of opposed open hems forming channels in which the flange of the tee end is received to join the tee to the clip. The clip can be elongated horizontally to accommodate movement of the grid during seismic activity. The clip can be used to trim the edges of a ceiling island and can be made to accommodate angular intersections of the grid with a wall or island edge.

8 Claims, 3 Drawing Sheets

WALL MOLD ATTACHMENT CLIP

The invention relates to suspended ceiling grid and, more particularly, to a clip for attaching grid tee ends to wall molding.

Prior Art

Suspended ceiling grid is normally made up of inverted tee shaped runners or tees that are arranged in a rectangular open grid pattern. Commonly, the ends of the tees, where they intersect with a wall, are simply laid onto the horizontal leg of a wall angle or wall molding. The vertical leg of the wall molding extends upwardly from the horizontal leg and is concealed by the horizontal leg and installed ceiling tiles. The vertical leg is nailed or screwed to the wall to support the wall molding and, in turn, the ends of the tees. Since the area of the vertical leg of the wall molding is concealed from view when the ceiling is completed, the fasteners used to secure it to the wall are unseen.

U.S. Pat. Nos. 4,715,161, 4,610,562 and 5,046,294 disclose types of clips that are used to attach ends of typical grid tees to wall moldings. U.S. Pat. Nos. 5,195,289 and 5,201,787 show a clip used to secure island trim to grid tees.

SUMMARY OF THE INVENTION

The invention provides a clip useful with suspended ceiling grid for attaching the ends of grid tees to wall angles or molding at selected or specified locations. The clip is arranged to be joined onto the end of the face or flange of a grid tee. The clip includes a formation, concealed in use, that interengages with the hem of a wall angle and to thereby lock the clip into position on the wall angle. In certain disclosed versions, the entire clip is concealed from view so as to yield an uninterrupted smooth finish on the visible portion of the wall angle and associated end of the tee.

In a reversal of roles, the clip can be used to mount the wall molding or its equivalent to the ends of the tees where the ceiling is constructed as an "island". The clip can, additionally, be configured to telescopically support a tee end during seismic disturbances. Still further, the clip can be arranged to receive a grid tee that, by design, intersects the wall molding at an angle other than a right angle. This variable angle clip can be arranged, as mentioned before, to mount a wall molding or its equivalent in an island-like configuration even where the molding is free form or otherwise non-rectangular at the perimeter of the ceiling.

DESCRIPTION OF THE PREFERRED EMBODIMENTS

Figure 1:
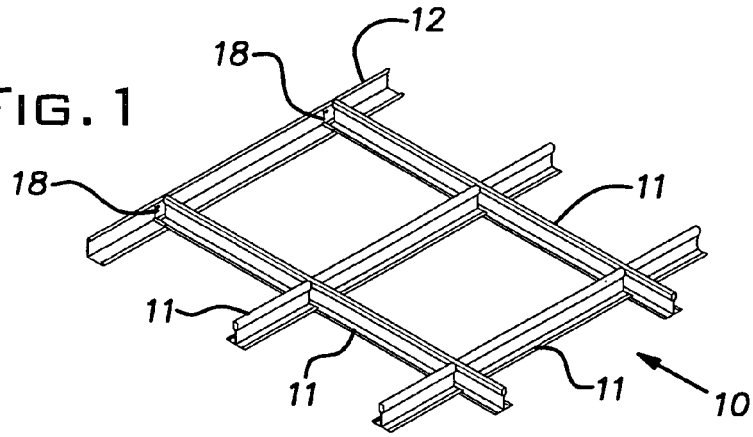
FIG. 1 is a fragmentary perspective view, looking from above, of a suspended ceiling grid employing the invention.

Referring now to FIG. 1, there is shown a portion of a suspended ceiling grid 10 including intersecting tees 11 and a wall angle or wall molding 12. The tees 11 can be relatively long main tees and relatively short cross tees as is customary. The illustrated tees are of a customary cross-section (FIG. 2) having a lower flange 13, the underside of which forms the face of the tee visible from below in a room, a vertical stem or web 14 and an upper hollow reinforcing bulb 15. The wall angle 12 illustrated in the figures has horizontal and vertical legs 17 and 25 of equal length (i.e. lateral width) and are each formed with a hem 16. Customarily, the wall molding 12 is an elongated roll-formed sheet metal structure having a nominal standardized width.

Figure 2:
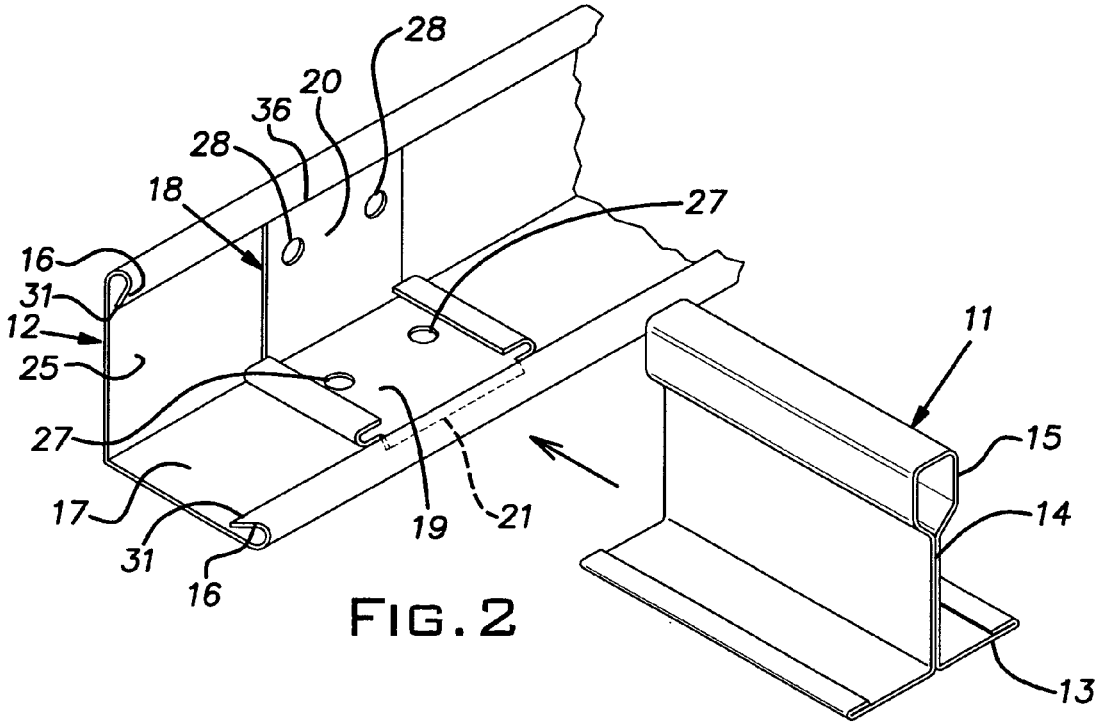
FIG. 2 is a fragmentary perspective view on an enlarged scale, of a first form of a clip for attaching the ends of grid tees to a wall molding.

As discussed hereinbelow, the ends of the tees 11 that overlie the horizontal leg 17 of the wall molding 12 are attached to the wall molding by individual clips 18, as suggested in FIG. 2. The clip 18, preferably formed of sheet metal, has a generally horizontal leg 19 and an integral generally vertical leg 20. At its end or edge remote from the vertical leg 20, the horizontal leg 19 includes an integral tongue 21. The tongue 21 extends substantially across the width of the clip, projects lengthwise a short distance from the horizontal leg, and is bent downwardly so that it forms an obtuse angle with the plane of the horizontal leg. The edges of the horizontal leg 19 are folded in the manner of a hem to form opposed channels 22. The hems, designated 23, are open sufficiently and their bight areas, designated 24, are spaced apart sufficiently from one another to receive the flange 13 of the end of an associated tee 11 with sufficient room to enable the tee flange 13 to be received within the hem formed channels 22 without the application of excessive force. The hems 23 are short enough to permit free passage therebetween of the web 14. For example, where the face of the flange is typically 15/16" in width, the distance between the bights 24 can provide a lateral clearance of roughly 1/32". The vertical distance between the hems 23 and main portion or body proper of the horizontal leg 19 can allow for minimal friction or a slight clearance with the thickness of the tee flange. The main portion of the horizontal leg 19 has a pair of laterally spaced holes 27 and the vertical leg 20 has a similar set of laterally spaced holes 28.

Figure 4:
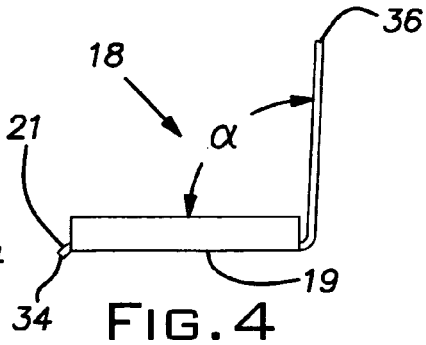
FIG. 4 is a side view of the clip of FIG. 2.

Ideally, the clip 18 is proportioned so that it snaps in the space included between the two wall molding hems 16. It can be difficult to precisely form the wall angle 12 so that the hems 16 are precisely open or precisely closed and/or to precisely position the free edges, designated 31, of the hems 16. The configuration and proportions of the clip 18 are intended to snap fit into the hem area of the wall molding 12 despite these variations. The tongue 21, by virtue of its downward inclination is potentially capable of at least partially wedging under the hem 16 of the horizontal wall molding leg 17. With reference to FIG. 4, it will be seen that the generally vertical leg 20 is originally formed with a slightly obtuse angle $\propto$ of say between about 91° and 101° to the plane of the main body portion of the horizontal leg 19. The clip 18 is enabled to snap into the space occluded by the hem edges 31 by proportioning the clip 18 so that the distance between the free edge of its tongue 21 and a remote edge 36 of its vertical leg 20, when the clip is in the free state illustrated in FIG. 4 is greater than the distance between the free edges 31 of the wall molding hem 16. In this situation, when the clip 18 is pressed into the space bounded by the wall molding hem free edges 31, the tongue 21 will lock against the free edge 31 of the horizontal wall molding leg 17 or will slip under its hem 16. Similarly, the edge 36 will tightly abut the free edge 31 of the hem 16 on the vertical leg 25 or will snap under this hem 16. Once the clip 18 is snapped in position so that it bears against the wall molding hem edges 31 or slips under one or both of them, the clip will be frictionally retained in its location. A moderate force can be applied to the clip manually to adjust it along the length of the wall angle 12.

Ordinarily, the clip 18 can be slipped onto the end of a tee 11 before the clip is installed at a desired location on the wall molding 12. The clip 18 is installed on the tee by simply slipping or telescoping the clip hems 23 and bights 24 over the lateral extremities of the tee flange 13 enabling these elements to grip the tee and prevent any significant relative movement between the clip and tee apart from telescoping motion along the longitudinal axis of the tee. Where desired, the tee 11 and clip 18 can be completely fixed relative to one another by assembling shallow head rivets or the like through the holes 27 in the main portion 26 of the horizontal clip leg 19 and through corresponding holes in the tee flange 13, the location and making of which is ordinarily accomplished in the field by the installer. Shallow head fasteners assembled from the visible or face side of the flange 13 through the holes 27 allow these fasteners to exist between the horizontal clip leg 19 and horizontal wall molding leg 17 so that they are concealed from view of an observer looking upwards at a finished ceiling. The clip 18 can be fixed relative to the wall angle or molding 12 by screws, nails, or the like, through one or both of the vertical leg holes 28 and the vertical leg 25 of the wall angle. Fasteners in the clip vertical leg holes 28, of course, cannot be seen from below the finished ceiling.

Various modified forms of the clip 18 are illustrated in FIGS. 5 through 15. Elements serving the same or essentially same function as that described above in connection with the clip 18 are designated by the same previously used numerals. Elements having different or supplemental functions are ascribed with a third digit number designation.

Figure 5:
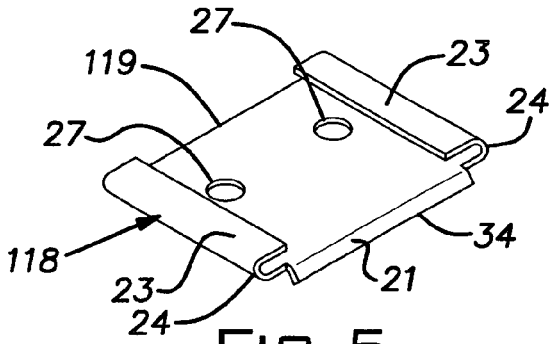
FIG. 5 is a perspective view of a modified form of the clip.

FIG. 5 illustrated a clip 118 that is devoid of the vertical leg 20 of the previously described clip 18. Here, in one approach the length of the clip 118 is such that the distance from the tongue free edge designated 34 to an opposite edge 119 is greater than the distance of a free edge 31 of a wall molding hem 16 (of a horizontal leg 17) to the vertical wall molding leg 25. This extra length between these edges 34 and 119 assures that the tongue 21 will, at least, interfere with the wall molding horizontal leg hem edge 31 or will be caused to slide under it. In either case of interference or fitting below the hem 16, the tongue 21 will lock the clip 118 in a selected position along the length of a wall molding 12. The clip 118 is most easily installed by abutting the tongue edge 34 with the wall molding horizontal leg hem edge 31 and then forcing the clip from any inclination downwardly until the edge 119 is adjacent the corner between the horizontal and vertical wall molding legs 17, 25. Once the clip 118 is pressed so that its edge 119 is at or adjacent the corner between the wall molding legs 17, 25, the clip is frictionally locked in position. In an alternative approach, the distance between the free edge 31 of the tongue 21 and the opposite edge 119 can be the same or less than the distance between the inside edge 31 of the hem 16 of the horizontal wall molding leg 17 and the vertical leg 25. The clip 118 is attached to a grid tee end with shallow head fasteners through holes 27 and aligned holes in the grid tee flange 13. Where the holes 27 are not used or are omitted, the clip 118 (as well as other clips disclosed herein) can be locked to the grid tee flange 13 by crimping the hems 23 onto the flange.

Figure 6:
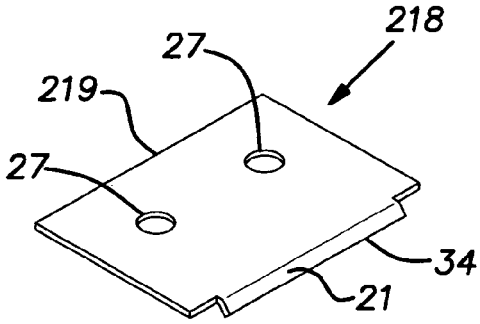
FIG. 6 is a perspective view of another modified form of the clip.
Figure 7:
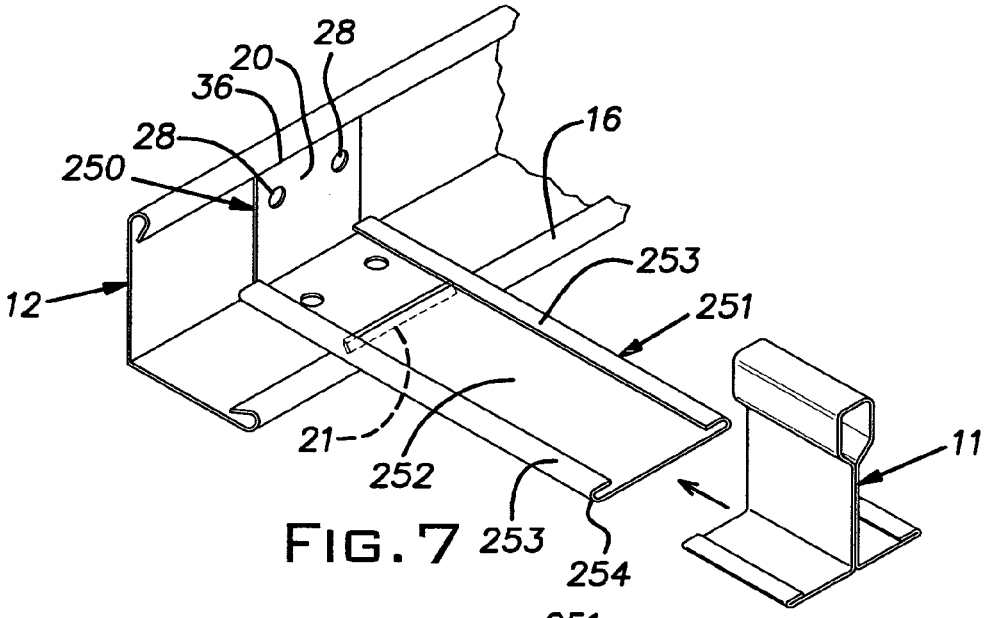
FIG. 7 is a perspective view of still another form of the clip specially suited for service in locales where seismic activity concerns exist.
Figure 9:
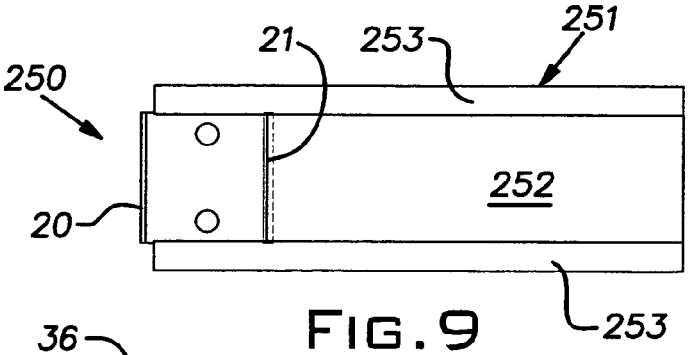
FIG. 9 is a plan view of the clip of FIG. 7.
Figure 8:
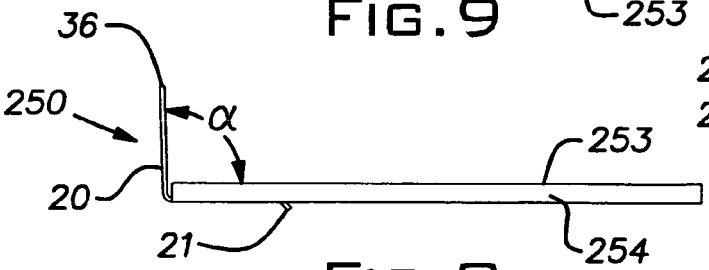
FIG. 8 is a side elevational view of the clip of FIG. 7.
Figure 10:
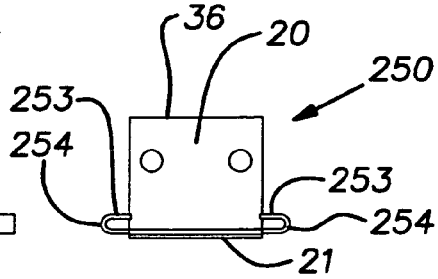
FIG. 10 is a front elevational end view of the clip of FIG. 7.

Referring to FIG. 6, a clip 218 differs from the 18 in that it is devoid of the vertical leg 20, hems 23, and bights 24. The clip 218 has an edge 219 corresponding to the edge 119 of the clip 118 of FIG. 5. The clip 218 is frictionally locked in position when the tongue edge 34 tightly abuts or slips under the wall molding horizontal leg hem free edge 31 and the edge 219 abuts or is adjacent the corner between the horizontal and vertical legs 17, 25 of the wall molding 12. Spaced holes 27 enable the clip 218 to be locked to the end of an associated tee 11 when screws, rivets or the like, are located in the holes and holes formed in the tee end.

FIGS. 7-10 illustrate a clip 250 suitable to be used, for instance, where seismic activity may be expected. The clip 250 has an elongated, e.g. 3" long, horizontal leg 251. The leg 251 includes a generally planar main body 252 with integral opposed hems 253 and bights 254 along its elongated edges. The hems 253 are open to enable the flange 13 of an end of a tee 11 to freely telescope therein along the longitudinal direction of the tee in the manner of a "trombone". Like the hems 23 and bights 24 of the clip 18, the hems 253 and bights 254 are proportioned to allow passage of the tee web 14 therebetween and limit relative motion between the clip 250 and tee 11 to longitudinal motion.

Figure 3:
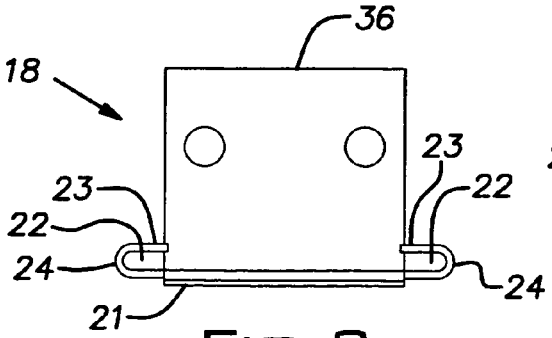
FIG. 3 is a front elevational view of the clip of FIG. 2.

The clip 250 has the geometry of the tongue 21 and relative geometry between the plane of the horizontal leg 19 and vertical leg edge 36 as described in connection with the clip 18 of FIGS. 2 through 4. Depending on where the end of the tee 11 is positioned, i.e. that dictated by the selected length of the tee, there can be about 1½" in free telescoping movement in each longitudinal direction of a tee in the event of seismic movement.

Figure 11:
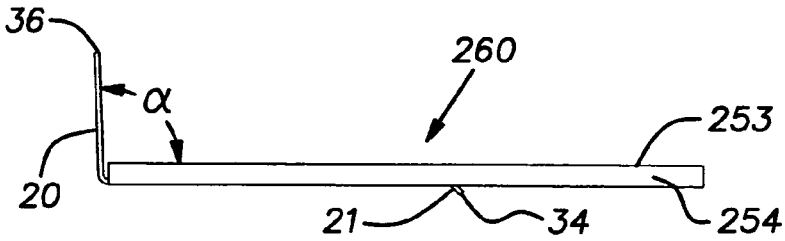
FIG. 11 is a side view of a clip modified in form from that shown in FIGS. 7-10.
Figure 12:
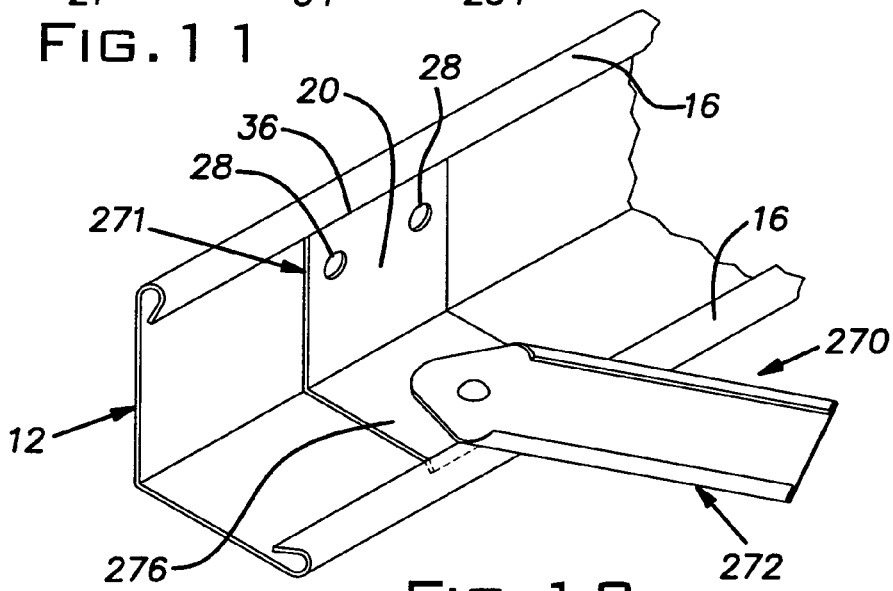
FIG. 12 is a fragmentary perspective view of a clip of modified form for use in instances where a tee intersects a wall molding at an angle other than 90°.
Figure 13:
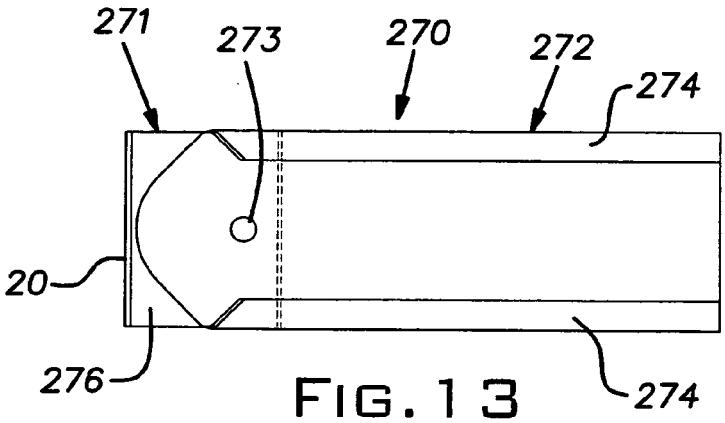
FIG. 13 is a plan view of the clip of FIG. 12.
Figure 14:
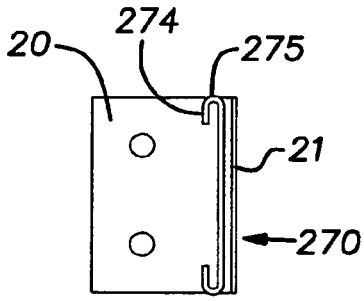
FIG. 14 is a front end view of the clip of FIG. 12.
Figure 15:
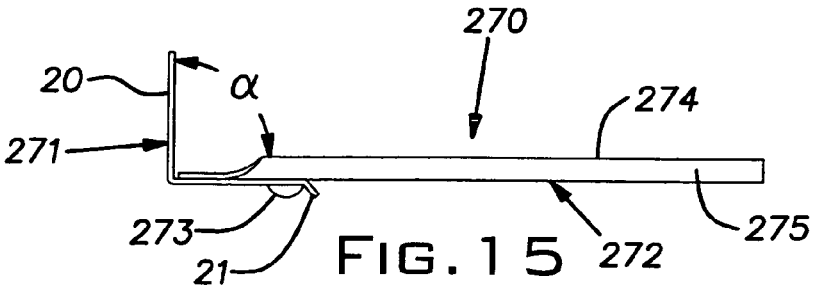
FIG. 15 is a side elevational view of the clip of FIG. 12.

FIG. 11 illustrates a side view of a clip 260 similar to the clip 250 of FIGS. 7-10. The clip 260 differs from the clip 250 in that the tongue 21 is spaced farther from the vertical leg 20 of the subject clip. The clip 260 is provided to work with a seismic wall molding. The distance between the tongue edge 34 and remote edge 36 of the vertical leg 20 is increased to match the corresponding pseudo hypotenuse dimension between the free edges of the hems of the seismic molding.

FIGS. 12 through 15 illustrate another form of a clip 270 for attaching the ends of grid tees to wall angles or similar elements. The clip 270 is an assembly including a base 271 and an arm 272 pivotally joined to the base by a pin or rivet 273 which may be a separate element or integrally formed from one or both the base and arm. The rivet 273 enables the arm 272 to pivot about its axis in a horizontal plane when the clip 270 is in the orientation shown in FIG. 12. The arm 272 from the rivet or pin 273 has a cross-section like that previously described in connection with the clip 18 of FIGS. 2 through 4 and the other modified clips, the arm including open hems 274 and bights 275. The clip 270 allows a tee 11 to be attached to a wall molding 12 while intersecting it in the horizontal plane of a leg 276 at an angle other than 90°. It will be seen that the arm 272 can be pivoted about the center of the rivet 273 to permit the arm 272 to receive a tee 11 intersecting the wall molding at an angle from nearly 0° to nearly 180°.

While the clip of FIGS. 12 through 15 is proportioned to work with a wall molding with a horizontal leg of conventional width, this clip can be modified to lengthen the horizontal portion of the base 271 so as to move the tongue 21 further from the vertical leg 20 so as to mate with a relatively wide or seismic wall molding.

Various ones of the disclosed clips can be conveniently used to support a wall molding or a similar structure when the roles of the tees and wall molding are reversed such as in an island ceiling treatment where the perimeter of the ceiling does not abut a wall. The clip 270 permits a wall angle or a similar structure to be supported on tees which intersect at one or more angles other than 90°.

While the invention has been shown and described with respect to particular embodiments thereof, this is for the purpose of illustration rather than limitation, and other variations and modifications of the specific embodiments herein shown and described will be apparent to those skilled in the art all within the intended spirit and scope of the invention. Accordingly, the patent is not to be limited in scope and effect to the specific embodiments herein shown and described nor in any other way that is inconsistent with the extent to which the progress in the art has been advanced by the invention.

What is claimed is:

1. A sheet metal clip for attaching the end of a grid tee, having an upper hollow reinforcing bulb, vertical web and lower face flange, to a wall molding formed as a right angle and having hems along its longitudinal edges, the clip forming a tongue for engaging the hem of a horizontal leg of the wall molding and a side opposite the tongue for engaging the other leg of the wall molding, the clip being proportioned to dimensionally interfere and thereby lock with the wall angle molding when the tongue and side engage respective parts of the wall molding, and a grid tee engaging part pivotally connected to the tongue and opposite side parts for movement in a horizontal plane, the tee engaging part including opposed gripping elements spaced apart by a distance corresponding to the width of the lower face flange of the grid tee and adapted to receive and laterally position the end of a grid tee flange relative to the wall molding, said gripping members forming opposed channels adapted to laterally constrain lower face flange edges.

2. A sheet metal clip as set forth in claim 1, wherein the grid tee engaging part is substantially longer than the distance between the tongue and the opposite side.

3. A suspended ceiling grid comprising a wall molding, grid tees, having an upper hollow reinforcing bulb, vertical web and lower face flange, and clips attaching the grid tees to the wall molding, the wall molding being an elongated roll-formed sheet metal part having the general cross-section of a right angle with horizontal and vertical legs joined at a corner, the legs at their free edges terminating with a re-entrant hem on a side of the respective leg facing the other leg, each hem having a free edge facing the corner and lying immediately adjacent its leg, the tees having ends supported on the wall molding, a clip being directly connected to its respective tee end by receiving and laterally constraining the lower face flange of a grid tee to restrict the tee end against lateral movement, each clip being retained in a selected position along the wall molding by an interference fit between the hem of the horizontal leg and the vertical leg, wherein the clip has intergral gripping members that engage the lower face flange of its respective tee end, wherein the gripping members from opposed channels on opposite sides of the lower face flange, the channels being portioned to allow the tee end to slide longitudinally within said channels, and wherein said channels are formed on a part of said clip that is pivotally connected to a part of said clip that provides said interference fit.

4. The suspended ceiling grid of claim 3, wherein the clips are each proportioned to engage and provide an interference fit between the hems of both legs of the wall molding.

5. The suspension ceiling grid of claim 3, wherein the flanges have edges and the gripping members are arranged to laterally constrain the flange edges.

6. The suspended ceiling grid of claim 5, wherein the gripping members are arranged to constrain the flange against vertical movement.

7. The suspended ceiling grid of claim 6, wherein the gripping members are arranged to constrain the tee ends laterally and vertically.

8. The suspended ceiling grid of claim 3, wherein said channels extend away from said vertical leg a distance substantially greater than the width of said horizontal leg.

* * * * *